United States Patent [19]

Pols

[11] Patent Number: 4,610,199

[45] Date of Patent: Sep. 9, 1986

[54] HYDRAULIC PRESS FOR COMPACTING DRUMS CONTAINING RADIO-ACTIVE WASTE

[75] Inventor: Pieter M. Pols, Maasland, Netherlands

[73] Assignee: Machinefabriek A. Fontijne B.V., Netherlands

[21] Appl. No.: 606,389

[22] Filed: May 2, 1984

[30] Foreign Application Priority Data

May 2, 1983 [NL] Netherlands ..... 8301541

[51] Int. Cl.[4] ..... B30B 1/23; B30B 1/32; G21F 9/36

[52] U.S. Cl. ..... 100/269 R; 100/915; 252/626; 252/633

[58] Field of Search ..... 422/159; 252/633, 626; 100/229 A, 229 R, 226, 246, 247, 248, 220, 240, 245, 252, 915, 269 R; 110/223

[56] References Cited

U.S. PATENT DOCUMENTS

| | | | |
|---|---|---|---|
| 188,693 | 3/1877 | Talbott | 100/915 |
| 2,083,032 | 6/1937 | MacMillin et al. | 100/915 |
| 3,195,448 | 7/1965 | Larsen et al. | 100/245 |
| 3,688,689 | 9/1972 | Fierle et al. | 100/915 |
| 3,717,089 | 2/1973 | Oles et al. | 100/915 |
| 3,768,398 | 10/1973 | Ullman, Jr. | 100/246 |
| 3,885,467 | 5/1975 | Merkin | 100/252 |
| 3,889,587 | 6/1975 | Wharton | 100/226 |
| 3,903,790 | 9/1975 | Gladwin | 100/245 |
| 4,011,810 | 3/1977 | Santic | 100/915 |
| 4,099,363 | 7/1978 | Wistinghausen et al. | 100/226 |

OTHER PUBLICATIONS

Fontune, 1984, Processing Nuclear Radwaste: A Reliable Contribution to a Safe Environment, 7 pages.

Fontune, 1984, Fontijne Automatic High-Pressure Compaction Facility: Processing Radioactive Waste, 5 pages.

*Primary Examiner*—Stephen J. Lechert, Jr.

*Assistant Examiner*—Howard J. Locker

*Attorney, Agent, or Firm*—Burns, Doane, Swecker & Mathis

[57] ABSTRACT

A hydraulic press for compacting drums containing radio-active waste. The press consists essentially of a press table, a set of vertical support pillars connected at the top to a hydraulic cylinder with a ram mounted therein, and of a pressure jacket hydraulically movable in the vertical direction between the ram and the press table along the support pillars. According to the invention, the lower end of the ram is provided with an annular chamber in which the pressure jacket is receivable in a retracted position.

2 Claims, 2 Drawing Figures

HYDRAULIC PRESS FOR COMPACTING DRUMS CONTAINING RADIO-ACTIVE WASTE

This invention relates to a hydraulic press for compacting drums containing radio-active waste, essentially consisting of a press table, a set of vertical support pillars connected at the top to a hydraulic cylinder with a ram arranged therein, and further of a pressure jacket hydraulically movable in the vertical direction between said ram and said press table along said support pillars.

A similar hydraulic press is known from a brochure entitled "Automatic High-pressure Compaction Facility", distributed by applicants. The hydraulic compacting press described in it, which is capable of delivering a pressure of 1500 ton, has been very satisfactory in practice, in particular because with such a press it was possible to realize a high density of the compacted, radio-active waste. This density was approximately 2.5, which, as compared with conventional waste presses, which were productive of a density of about 0.6 to 0.8, gives an improvement of a factor of 3. Constructionally, this prior press has a number of disadvantages, in particular its overall height, which is approximately 6 m. Owing to this great height, the compacting press can only be used in high halls. A further disadvantage is that the ram cannot rotate relatively to the support pillars, so that a pressure disk must be mounted at the lower end of the ram, which disk must be movable in a rotary direction relatively to the ram. In fact, practice has shown that the drums containing radio-active waste to be compacted often contain steel bars, which load the ram eccentrically, and in particular in the rotary direction, and may cause the ram to jam if the pressure disk mounted at the lower end of the ram were not rotatable relatively to the ram in some way. In the prior construction this rotatability of the pressure disk is realized by a bolt connection, the bolts of which break from shearing at a certain overload in the rotary direction, whereafter the pressure disk must be re-secured to the lower end of the ram.

It is an object of the present invention to improve a press of the type described above so as to realize a considerably lower overall height, and prevent failures as a result of break-down of the connection between the pressure disk and the ram. For this purpose the apparatus according to the invention is characterized in that the lower end of the ram is provided with an annular chamber in which the pressure jacket is receivable in a retracted position. Owing to this measure, the hydraulic cylinder in which the ram is accommodated can be arranged at a considerably lower height, owing to which the support pillars can be made considerably shorter.

In a further embodiment, the ram is composed of two telescoping plungers, including a double-acting central plunger fixedly connected to the hydraulic cylinder, and an outer plunger freely rotatable about the inner plunger. Owing to this arrangement, the fixed connection, in a rotary direction, between the ram and the support pillars is broken, and the hydraulic plunger is capable of free rotation within the cylinder, so that an oblique load in the rotary direction of the ram can no longer lead to break-down of the connection between the pressure disk and the ram.

In order that the inner wall of the hydraulic cylinder, which becomes exposed owing to the arrangement of an annular chamber, may be protected from damage, there is preferably provided a skirt guarding the cylinder wall at the lower end of the outer plunger.

One embodiment of the compacting press according to the invention will now be described, by way of example, with reference to the accompanying drawings. In said drawings.

Figure 1:
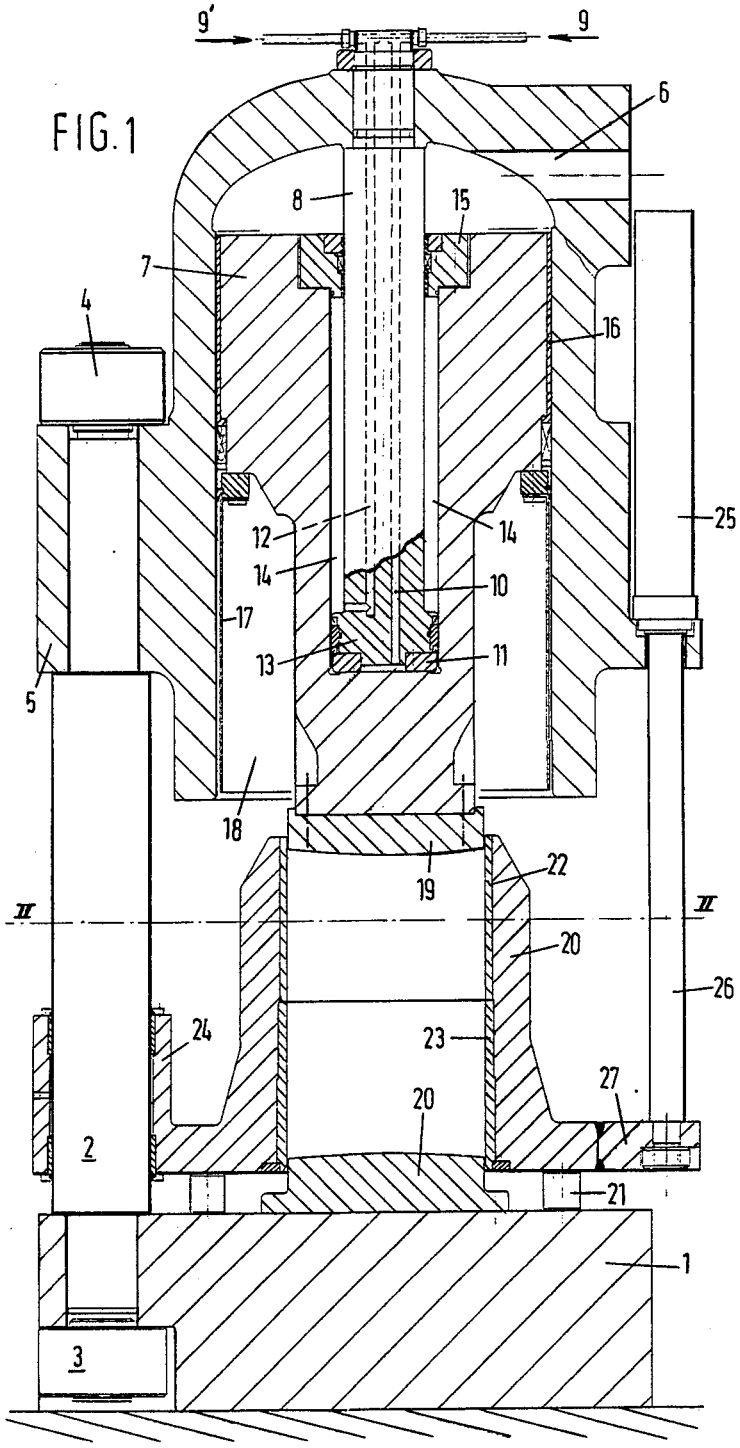
FIG. 1 shows a longitudinal sectional view of a hydraulic press according to the present invention.
Figure 2:
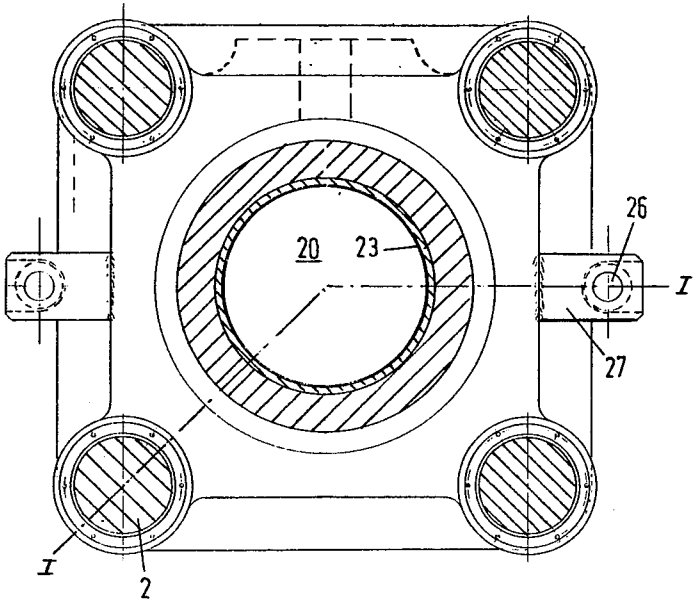
FIG. 2 shows a cross-sectional view at the level of the pressure jacket when it is in its lowered position.

In FIG. 1, the press table is supported on a heavy foundation not shown. Provided at the four corners of the press table 1, are four support pillars 2, secured to the press table 1 by means of nuts 3. Supported on the support pillars 2 is a hydraulic cylinder 5, secured to support pillars 2 by means of nuts 4. The hydraulic cylinder 5 is bell-shaped, and provided at the top with an oil inlet 6, terminating in a pressure chamber located above the ram 7. The ram consists of two telescoping plungers 7, 8, with the central plunger 8 being fixedly connected to the top of the hydraulic cylinder 5. The outer plunger 7 is freely rotatable about the central plunger 8, which central plunger is provided at the lower end with a piston 13, the upper end of the central plunger 8 being received in ring 15 provided in the upper portion of the outer plunger 7. Piston 13 and ring 15 are provided with oil seals in the usual way. Provided in the central plunger 8 are two oil passages 10, 12, passage 10 of which terminates in the pressure chamber 11 located below piston 13, and passage 12 terminating in an annular space 14 between the outer wall of the central plunger 8 and the inner wall of the outer plunger 7. Passage 10 is connected to an oil supply and discharge duct 9 located outside the hydraulic cylinder 5, and passage 12 is connected to the oil supply and discharge duct 9'. There is thus obtained a double-acting ram. When oil is supplied in passage 9, 10, the pressure chamber 11 is put under oil pressure, and the outer plunger 7 will be displaced downwardly, whereby oil can flow away from the annular space 14 through passage 12, 9'. When oil under pressure is supplied through duct 9', the annular space 14 is put under pressure, and the outer plunger 7 can be displaced in the upward direction. Accordingly, the hydraulic cylinder built-in in plunger 7 serves for the upward stroke of plunger 7 and for the first fast portion of the press stroke. Provided on the cylindrical outer wall of the outer plunger 7 is a sliding lining 16. The lower end of the outer plunger has a considerably smaller diameter than the upper end of the outer plunger adjacent lining 16. In this way there is produced an annular chamber 18 capable of receiving a pressure jacket 20 to be placed around a drum to be compacted. Provided at the bottom end of the outer plunger 7 is a pressure disk 19 fixedly connected to the outer plunger 7.

As shown in the drawing, there is no connection whatsoever between the outer plunger and the fixed part of the structure, essentially consisting of the support pillars 2, so that the outer plunger 7 is freely rotatable about the sliding lining 16 within the hydraulic cylinder 5. In the rotary direction, therefore, the outer plunger can find its optimum position, depending on the contents of the drum being compacted. The inner wall of the hydraulic cylinder 5 is protected by a skirt depending from the lower end of the outer plunger 7, which skirt is connected in a suitable manner to the broad portion of the outer plunger 7.

During the compacting of a drum filled with radioactive waste, which drum is placed on a pressure disk 20 supported on press table 1, the drum must be surrounded by a pressure casing or jacket 20, which via guiding sleeves 24 is movable along the support pillars 2 by means of auxiliary cylinders 25 accommodating auxiliary plungers 26. The end of auxiliary plunger 26 is connected to lateraly projecting lugs 27 provided at the lower end of pressure jacket 20. In its lowered position, jacket 20 rests on an array of stops 21 placed around pressure disk 20 on press table 1. Provided on the inside of the pressure jacket are two steel liners 22, 23 to prevent damage to the inner wall of jacket 20. In order that liner 22, 23 may be readily replaced, it is of divided form, with the interface being located approximately halfway the height of jacket 20.

What I claim:

1. A hydraulic press for compacting drums containing radio-active waste, comprising: a press table, a set of vertical support pillars connected at the top to a hydraulic cylinder with a ram mounted therein, a pressure jacket hydraulically movable in the vertical direction between said ram and said press table along said support pillars, wherein said ram comprises two telescoping plungers, including a double-acting central plunger fixedly connected to said hydraulic cylinder, and an outer plunger freely rotatable about said inner plunger, a lower end of said ram being provided with an annular chamber in which said pressure jacket is receivable in a retracted position.

2. A hydraulic press according to claim 1, characterized in that said outer plunger is provided at its lower end with a skirt guarding the wall of said hydraulic cylinder.

* * * * *